United States Patent [19]

Boor

[11] 3,958,660

[45] May 25, 1976

[54] MUFFLER SYSTEM

[76] Inventor: Elijah M. Boor, R. R. 2, McCune, Kans. 66753

[22] Filed: Jan. 22, 1975

[21] Appl. No.: 543,031

[52] U.S. Cl. ..... 181/57; 181/47 R
[51] Int. Cl.[2] ..... F01N 1/08
[58] Field of Search ..... 181/35 R, 41, 47 R, 181/49, 57, 63, 70

[56] References Cited

UNITED STATES PATENTS

| | | | |
|---|---|---|---|
| 2,205,024 | 6/1940 | Zinsitz | 181/57 |
| 2,516,948 | 8/1950 | Bourne | 181/70 X |
| 2,958,390 | 11/1960 | Montague | 181/57 |
| 3,080,939 | 3/1963 | Kelly | 181/57 X |
| 3,317,001 | 5/1967 | Powers et al. | 181/47 R |
| 3,480,105 | 11/1969 | Burris | 181/47 R |

FOREIGN PATENTS OR APPLICATIONS

| | | | |
|---|---|---|---|
| 465,858 | 5/1937 | United Kingdom | 181/57 |

*Primary Examiner*—John Gonzales
*Attorney, Agent, or Firm*—Lowe, Kokjer, Kircher, Wharton & Bowman

[57] ABSTRACT

A muffler system having the advantages of a straight pipe yet with sound abatement qualities comparable to those of a conventional muffler is provided. A substantially hollow elongated shell forms the body of the muffler and is provided with an inlet port at one end disposed in offset relationship to an outlet port at the opposite end. An exhaust pipe which is coupled with the engine extends into the hollow shell through the inlet port and terminates at a point interiorly of the hollow shell in a bevel end. The longest side of the bevel end is turned down into a gas dispersing finger point and is provided with a straight slot while the shorter side of the exhaust pipe is provided with a tapered slot extending longitudinally toward the end of the muffler so as to further facilitate dissipation of the gases. A similarly constructed outlet pipe extends into the hollow shell of the muffler through the outlet port. The outlet pipe is also provided with a bevel end having a finger projection extending downwardly from the tip of the end into the gas stream. The outlet pipe also has opposed coplanar elongated slots extending toward the outlet end of the hollow shell. In a modified form of the invention a partition disposed within the hollow shell divides the latter into a plurality of muffling chambers, with one chamber directly behind the other.

10 Claims, 5 Drawing Figures

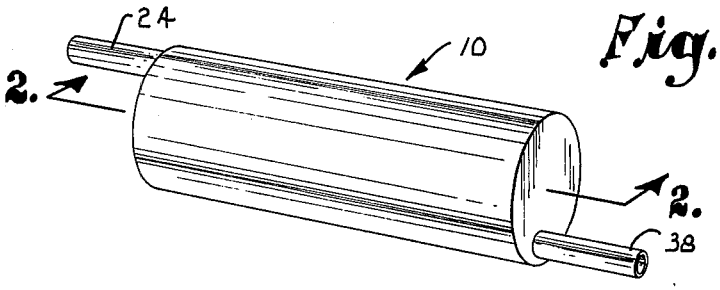
Fig. 1.
Fig. 2.
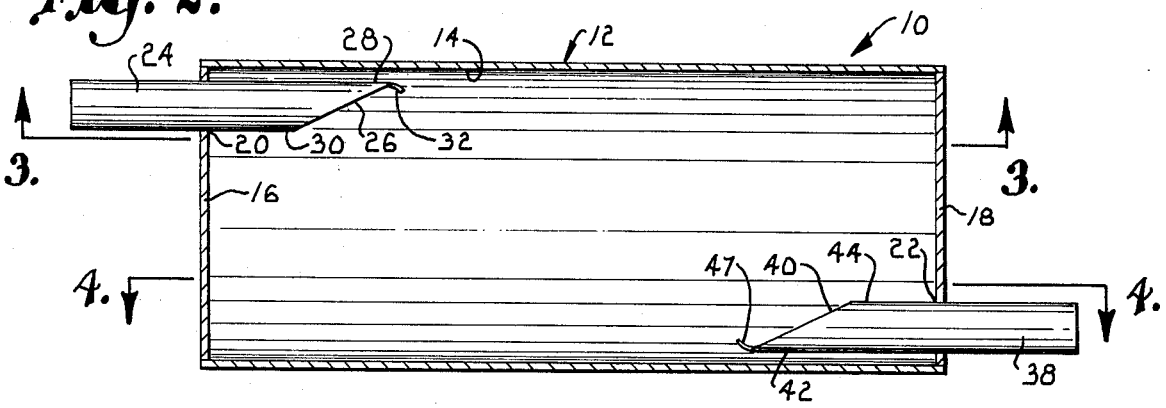
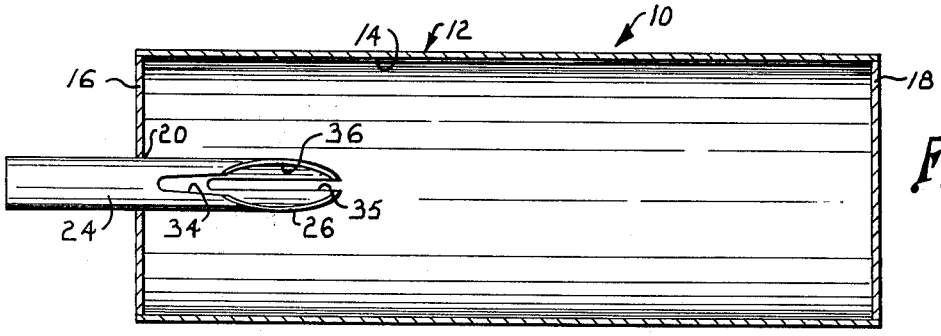
Fig. 3.
Fig. 4.
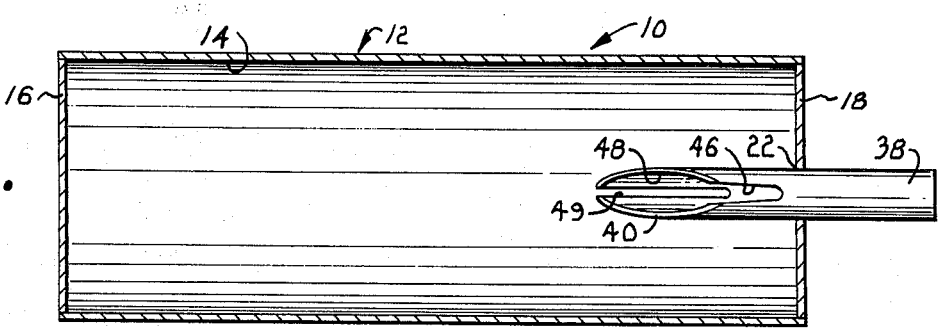
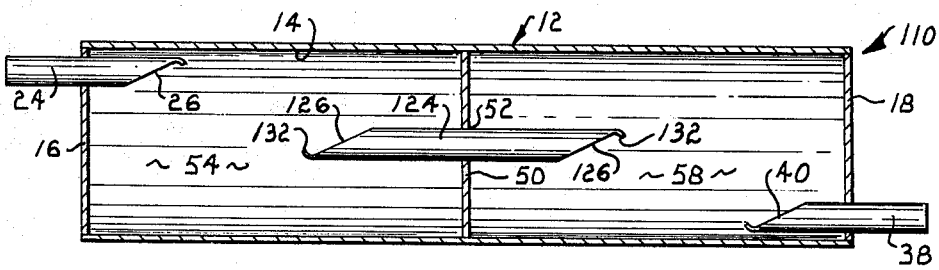
Fig. 5.

MUFFLER SYSTEM

This invention relates to mufflers for internal combustion engines generally and, more particularly, to a muffler which greatly reduces engine back pressure.

Mufflers for internal combustion engines are required by law to minimize noise. With greater and greater emphasis on noise abatement mufflers have become more and more characterized by increasingly complicated "internal works". The "internal works" normally include a complicated series of plates, baffles and perforated shields through which the exhaust gases must pass before finally exiting through the tail pipe. While such constructions have been relatively effective in reducing engine noise, they have also become more and more expensive to manufacture. Even more importantly, mufflers constructed according to the teachings of the prior art cause considerable back pressure on the engine thus decreasing engine performance and particularly lowering effective power. The back pressure also has an adverse effect on fuel consumption.

It is therefore a primary object of the present invention to provide a muffler construction which substantially reduces the "internal works" of the muffler thereby reducing back pressure on the engine and increasing the effective power of the engine.

It is also an object of this invention to provide a muffler system as described in the foregoing object which enhances overall engine performance by greatly reducing back pressure on the engine.

It is still another aim of this invention to provide a muffler construction which utilizes a substantially hollow elongated shell to muffle the engine sound without creating excessive back pressure on the engine, thereby providing for increased fuel economy.

This invention has as one of its objectives the provision of a muffler system which is substantially more economical to construct as a result of the elimination of most of the "internal works" of the muffler yet without sacrificing to any substantial degree the sound abatement qualities of the muffler.

Still another object of the invention is to provide a muffler construction as described in the foregoing objects which may be adapted to different types and sizes of engines and which may be constructed in a single stage or multiple stages to meet specific requirements of different types of engines.

Other objects of the invention will be made clear or become apparent from the following description and claims when read in light of the accompanying drawing wherein:

FIG. 1 is a perspective view of a muffler constructed according to my invention;

FIG. 2 is a horizontal cross-sectional view through the muffler on enlarged scale and taken along line 2—2 of FIG. 1;

FIG. 3 is a horizontal cross-sectional view taken along line 3—3 of FIG. 2 and looking in the direction of the arrows;

FIG. 4 is a horizontal cross-sectional view showing the lower half of the muffler and taken along line 4—4 of FIG. 2; and FIG. 5 is another cross-sectional view illustrating a modified form of the invention.

Referring initially to FIGS. 1 and 2, the muffler of the present invention is designated generally by the numeral 10 and is comprised of a generally cylindrical hollow shell designated generally by the numeral 12. Hollow shell 12 is comprised of a circumferentially extending side wall 14 and end walls 16 and 18.

End wall 16 is provided with an inlet opening 20 disposed to one side of the center of the wall and adjacent to side wall 14. The opposite end wall 18 is provided with an outlet opening 22 which is disposed to one side of the wall on the opposite side of a center line from opening 20. This places openings 20 and 22 is offset relationship to each other with both openings adjacent side wall 14.

Extending through opening 20 and into the interior of shell 12 is an exhaust pipe 24 which is characterized by a bevel end 26. Bevel end 26 is cut at an angle of from 25°–35° relative to the side wall of pipe 24 and presents a longest side 28 of pipe 24 and a shortest side 30 extending into the interior of shell 12. At the terminal end of longest side 20 a finger-like projection 32 is provided and this may be an integral extension of side 28. As illustrated in FIG. 3, extending back toward end wall 16 along shortest side 30 from bevel end 26 is a slot 34. Slot 34 has a length approximately equal to the transverse width of bevel end 26. It is also to be noted that the slot diverges as it approaches end 26. The open area presented by slot 34 merges into an opening 36 defined by beveled end 26. A second slot 35 extends longitudinally along side 28 in opposed coplanar relationship to slot 34.

Referring additionally now to FIG. 4, it is seen that an outlet pipe 38 extends through opening 22 into the interior of shell 12 in the same manner as exhaust pipe 24. Outlet pipe 38 also terminates in a bevel end 40 which presents a longest side 42 and a shortest side 44 of pipe 38 extending inwardly from end wall 18. Longest side 42 terminates in a finger-like projection 47 which extends inwardly toward an imaginary extension of shortest side 44.

Shortest side 44 also presents a slot 46 extending longitudinally in the direction of end wall 18. Slot 46 merges into an opening 48 presented by end 40. The angle of bevel end 40 is also preferably between 25°–35° relative to the side wall of outlet pipe 38. A second slot 49 extends along side 42 in opposed coplanar relationship to slot 46.

In operation, exhaust pipe 24 is coupled with the exhaust system of an internal combustion engine. Exhaust gases are directed into hollow shell 12 and as the gases pass along pipe 24 they will begin to dissipate as they emanate from slots 34 and 35. This gradual dissipation of the gases before they reach opening 36 is a major factor in also dissipating the sound produced by the firing engine. Projection 32 which extends into the gas stream emanating from opening 36 further dissipates the gas stream and also the noise associated with it. The gases and the sound waves will, of course, fill shell 12 and will be further dissipated as they travel the indirect route between opening 36 and opening 48. This facilitates further dissipation of the gases and the accompanying noise before the exhaust finally exits through pipe 38. To this end, slots 46 and 49 and projection 47 also facilitate a final breakup of the gas stream before it leaves the muffler.

A modified form of the invention is illustrated in FIG. 5 and designated generally by the numeral 110. Muffler 110 is also comprised of a hollow shell 12 with the addition of a lateral partition 50 disposed in spaced relationship with each end wall 16 and 18 at a point generally midway along the length of shell 12. Partition 50 is provided with an opening 52 aligned at a point generally axially with the center of shell 12. A tubular pipe 124 extends through opening 52 and each end of pipe 124 is provided with a beveled end 126. A finger-like projection 132 extends from the longest side of each end of pipe 124 in the direction of an imaginary extension of the shortest side of the pipe. Thus partition 50 provides two chambers 54 and 56 within shell 12 which chambers are intercommunicated by pipe 124. Each end of pipe 124 is disposed in somewhat offset relation to exhaust pipe 24 and outlet pipe 38. Although omitted from the drawing for the sake of brevity, it is to be understood that each pipe 124 would be constructed with slots such as the slots 34, 35, 46 and 47 for pipes 24 and 38 described above.

In operation of the modified form of the invention, pipe 24 is again coupled with the exhaust of an internal combustion engine and the gases are dissipated as they travel the serpentine path through pipes 124 and chambers 54 and 56 before reaching outlet pipe 38. Although it is not necessary to compartmentalize shell 12 in most instances, this compartmentalization does provide for even greater increased noise abatement in those extreme cases where it is needed.

It is to be understood that with both embodiments of the invention the outer shell 12 is preferably constructed from relatively heavy gauge metal since there is less support for the shell interiorly than is the case with prior art mufflers. Also, in both embodiments the slots extending away from the pipe openings should have a width which is no greater than one fourth of the diameter or width of the pipe opening. It will be appreciated that with either form of the invention construction costs are substantially reduced over known prior art devices. It should be understood that the muffler of the invention can be used with any form of internal combustion engine whether it be fueled by gasoline, deisel, or some other combustible mixture. While it is contemplated that the invention will find particular application with vehicles including automobiles, trucks and tractors, it should also be understood that it can also be utilized with a stationary engine employed in a power train.

I claim:

1. A muffler for an internal combustion engine, said muffler comprising:

an elongated hollow shell having an inlet port at one end and an outlet port at the opposite end;

an exhaust pipe coupled with said engine and extending into said shell through said inlet port, said exhaust pipe terminating away from said one end in a bevel end presenting a longest side and a shortest side of said pipe, said exhaust pipe having a first slot therein extending from said bevel end along said shortest side in the direction of said one end of the shell, said first slot being of tapered configuration as it extends toward said one shell end and terminating in a smoothly curved end toward said one shell end, said exhaust pipe having a second slot therein extending from said bevel end along said longest side in the direction of said one end of the shell, said second slot being greater in length than said first slot and terminating more closely to said one shell end than the end of said shortest side, the ends of said first and second slots toward said one shell end being staggered longitudinally of the pipe; and a short finger projection rigid with said exhaust pipe and extending from the longest side thereof toward an imaginary extension of said first slot, said finger projection terminating in a tip that would be located within an imaginary longitudinal extension of said exhaust pipe.

2. The invention of claim 1, wherein is included an outlet pipe extending into said shell through said outlet port, said outlet pipe terminating away from said opposite end in a bevel end presenting a longest side and a shortest side of the outlet pipe, said outlet pipe further having a first slot therein extending from said bevel end along said shortest side of the outlet pipe in the direction of said opposite end of the shell.

3. The invention of claim 2 wherein a second slot is presented in said longest side of the outlet pipe extending from said bevel end in the direction of said opposite end of said shell and in opposed coplanar relationship to the first slot of said outlet pipe.

4. The invention of claim 2, wherein said inlet port is disposed to one side of the center of said shell and said outlet port is disposed to the opposite side of the center of the shell.

5. The invention of claim 4, wherein the longest sides of said exhaust pipe and said outlet pipe are adjacent the walls of said shell thereby placing said first slots of the outlet and exhaust pipes in facing relationship.

6. The invention of claim 5, wherein is included a short finger projection rigid with said outlet pipe and extending from the longest side thereof toward an imaginary extension of the outlet pipe first slot, the finger projection of said outlet pipe terminating in a tip that would be located within an imaginary longitudinal extension of said outlet pipe.

7. The invention of claim 1, wherein is included partition means extending across said shell intermediate the inlet and outlet ports, tubular means extending through said partition means and presenting an extension into the interior of said shell on the inlet side of said partition means, said extension terminating in a first bevel end presenting a first longest side and a first shortest side of said extension, both of said sides extending from one side of said partition means, said extension having a first slot therein extending from said first bevel end along said shortest side of the extension in the direction of said partition means.

8. The invention of claim 7, wherein said extension terminates in a second bevel end presenting a second longest side and a second shortest side of said extension, both of said second sides extending from the other side of said partition means, said extension having a second slot therein extending from said second bevel end along said second shortest side in the direction of said partition means.

9. The invention of claim 8, wherein each of said first and second longest sides presents an additional slot in opposed coplanar relationship to each of said first and second slots of said extension.

10. The invention of claim 8, wherein said tubular means extending through said partition means is disposed in axial alignment with the center of said shell.

* * * * *